US009837014B2

(12) United States Patent
Kim et al.

(10) Patent No.: US 9,837,014 B2
(45) Date of Patent: Dec. 5, 2017

(54) METHOD OF DRIVING ORGANIC LIGHT EMITTING DIODE DISPLAY DEVICE

(71) Applicant: LG Display Co., Ltd., Seoul (KR)

(72) Inventors: Dae-Hyun Kim, Seoul (KR); Woo-Jin Nam, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 109 days.

(21) Appl. No.: 14/582,192

(22) Filed: Dec. 24, 2014

(65) Prior Publication Data

US 2015/0187261 A1 Jul. 2, 2015

(30) Foreign Application Priority Data

Dec. 30, 2013 (KR) ..... 10-2013-0167749

(51) Int. Cl.
*G09G 3/32* (2016.01)
*G09G 3/3208* (2016.01)
*G09G 3/3233* (2016.01)

(52) U.S. Cl.
CPC ..... *G09G 3/3208* (2013.01); *G09G 3/3233* (2013.01); *G09G 2300/0842* (2013.01); *G09G 2320/0219* (2013.01); *G09G 2320/0233* (2013.01); *G09G 2320/0295* (2013.01); *G09G 2320/043* (2013.01); *G09G 2360/16* (2013.01)

(58) Field of Classification Search
CPC .. G09G 3/3208; G09G 3/3233; G09G 3/3413; G09G 3/2003; G09G 3/3607; G09G 2320/0233; G09G 2320/0242
See application file for complete search history.

(56) References Cited

U.S. PATENT DOCUMENTS

2010/0091030 A1* 4/2010 Park ..... G09G 3/2003 345/589
2014/0198140 A1* 7/2014 Yano ..... G09G 5/10 345/696
2015/0091950 A1* 4/2015 Park ..... G09G 3/3291 345/690

FOREIGN PATENT DOCUMENTS

EP 2 178 072 B1 7/2013

OTHER PUBLICATIONS

Office Action dated Sep. 7, 2017, issued in corresponding German Patent Application No. 10 2014 119 630.9.

* cited by examiner

*Primary Examiner* — Benjamin C Lee
*Assistant Examiner* — Xuemei Zheng
(74) *Attorney, Agent, or Firm* — Morgan, Lewis & Bockius LLP

(57) ABSTRACT

A method of driving an organic light emitting diode display device having first to third sub-pixels and a white sub-pixel comprises judging a gray level of an image data; classifying the image data into a low gray level group, a middle gray level group and a high gray level group; displaying an image using the first to third sub-pixels except the white sub-pixel when the gray level of the image data is classified into the low gray level group; and displaying the image using the first to third sub-pixels and the white sub-pixel when the gray level of the image data is classified into one of the middle and high gray level groups.

11 Claims, 10 Drawing Sheets

METHOD OF DRIVING ORGANIC LIGHT EMITTING DIODE DISPLAY DEVICE

The present application claims the benefit of priority of Korean Patent Application No. 10-2013-0167749 filed in Korea on Dec. 30, 2013, which is hereby incorporated by reference for all purposes as if fully set forth herein.

BACKGROUND

Field of the Disclosure

The present disclosure relates to a method of driving an organic light emitting diode display device and, more particularly, to a method of driving an organic light emitting diode display device where sub-pixels for displaying an image are determined according to a gray level.

Discussion of the Related Art

Recently, as information technology has progressed, display devices have rapidly advanced. Among the advances is a flat panel display (FPD) having an excellent performance, such as a thin profile, a light weight and a low power consumption. In particular, a liquid crystal display (LCD) device and an organic light emitting diode (OLED) display device have been widely used.

The OLED display device of an emissive type has advantages such as a simple fabrication process, a thin profile and a light weight as compared with the LCD device requiring a backlight unit as an additional light source. Also, the OLED display device has an excellent viewing angle and an excellent contrast ratio as compared with the LCD device. Further, the OLED display device is driven with a direct current (DC) low voltage due to the low power consumption. As a result, a driving circuit is easily fabricated and designed. Moreover, since inner elements of the OLED display device are formed of solid build, the OLED display device has advantages such as excellent durability against an external impact and a wide temperature range of operation.

The OLED display device has been researched for a wider application range according to user's various demands. For example, the OLED display device has been utilized as a monitor of a desktop computer and a wall-mountable television as well as a portable computer. The OLED display device having a larger display area also has been researched.

The OLED display device displays an image using three primary colors such as red, green and blue. Recently, the OLED display device has displayed an image using four colors such as red, green, blue and white to increase brightness and decrease power consumption.

FIG. 1 is a graph illustrating a luminance according to a gray level of an organic light emitting diode display device having red, green, blue and white sub-pixels according to the related art. FIG. 2 is a graph illustrating a luminance ratio according to a gray level of an organic light emitting diode display device having red, green, blue and white sub-pixels according to the related art. FIG. 3 is a graph illustrating a data voltage according to a gray level of an organic light emitting diode display device having red, green, blue and white sub-pixels according to the related art.

With reference to FIG. 1, when a white image is displayed using red, green, blue and white sub-pixels, most luminance is expressed by the white sub-pixel and the other luminance for adjusting a color corresponding to a required color temperature is expressed by the red, green and blue sub-pixels.

With reference to FIG. 2, for example, when a white image having a luminance ratio of about 100% is displayed, the white sub-pixel expresses a luminance ratio of about 80% and the red, green and blue sub-pixels express a luminance ratio of about 20%. Accordingly, as a gray level increases, a data voltage for driving a light emitting diode of the white sub-pixel increases.

With reference to FIG. 3, for example, although the data voltage of the red, green and blue sub-pixels for a $255^{th}$ gray level is about 4V, the data voltage of the white sub-pixel for a $255^{th}$ gray level is about 16V.

As a result, the red, green and blue sub-pixels of the four sub-pixels are driven with a lower data voltage as compared with the white sub-pixel of the four sub-pixels and as compared with the red, green and blue sub-pixels of the three sub-pixels.

However, since the data voltage of the red, green and blue sub-pixels is reduced, luminance uniformity of a display panel is reduced due to a noise when a relatively low gray level is expressed. For example, as illustrated in FIG. 3, although the data voltage of the white sub-pixel for a $96^{th}$ gray level is about 6V, the data voltage of the red, green and blue sub-pixels for a $96^{th}$ gray level is about 2V.

FIG. 4 is a graph illustrating a fluctuation of a data voltage due to a noise of an organic light emitting diode display device according to the related art. FIG. 5 is a picture illustrating a non-uniformity in luminance when a relatively low gray level is expressed by an organic light emitting diode display device according to the related art.

With reference to FIG. 4, the data voltage of an OLED display device including the three sub-pixels is a first voltage V1, and the data voltage of an OLED display device including the four sub-pixels is a second voltage V2 smaller than the first voltage V1. The data voltage of the second voltage V2 is vulnerable to noise as compared with the data voltage of the first voltage V1. The noise may be caused by a coupling such as a kick-back phenomenon due to a load between a transistor and a gate line or by an external circuit.

With reference to FIG. 5, when an image of a relatively low gray level displayed by the display panel has poor luminance uniformity, a linear stain is shown due to high and low luminance portions.

SUMMARY OF THE INVENTION

Accordingly, the present invention is directed to a method of driving an organic light emitting diode display device that is capable of improving luminance uniformity, thereby substantially obviating one or more of the problems due to limitations and disadvantages of the related art.

An object of the present invention is to provide a method of driving an organic light emitting diode display device that is capable of improving luminance uniformity.

Additional advantages, objects, and features of the invention will be set forth in the description which follows, and in part will become apparent from the description, or may be learned by practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of driving an organic light emitting diode display device having first to third sub-pixels and a white sub-pixel includes: judging a gray level of an image data; displaying an image using the first to third sub-pixels except the white sub-pixel when the gray level of the image data is classified into a low gray level group; and displaying the image using the first to third sub-pixels and the white sub-pixel when the gray level of the image data is classified into one of middle and high gray level groups.

In another aspect, a method of driving an organic light emitting diode display device having first to third sub-pixels and a white sub-pixel includes: judging a gray level of an image data; and displaying an image by adjusting a luminance ratio of the first to third sub-pixels and the white sub-pixel according to the gray level of the image data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to the preferred embodiments, examples of which are illustrated in the accompanying drawings. The same reference numbers may be used throughout the drawings to refer to the same or like parts. In the following description, detailed descriptions of known functions and configurations incorporated herein will be omitted when it may obscure the subject matter of the present embodiments.

Hereinafter, exemplary embodiments will be described in detail with reference to FIGS. 6 to 13.

Figure 6:
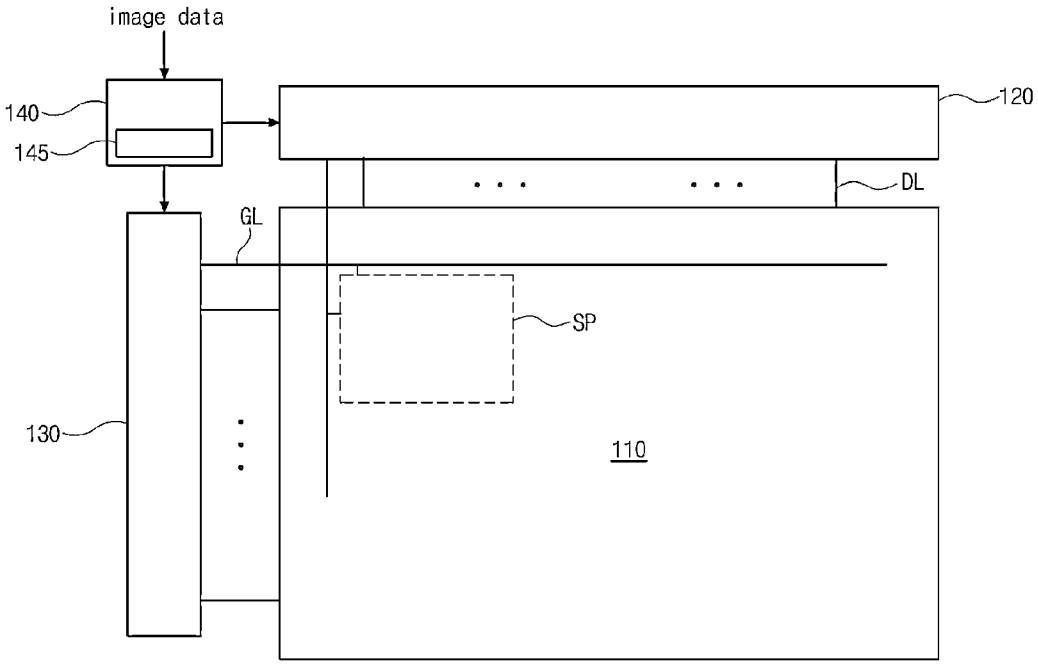
FIG. 6 is a view illustrating an organic light emitting diode display device according to a first exemplary embodiment of the present invention.
Figure 7:
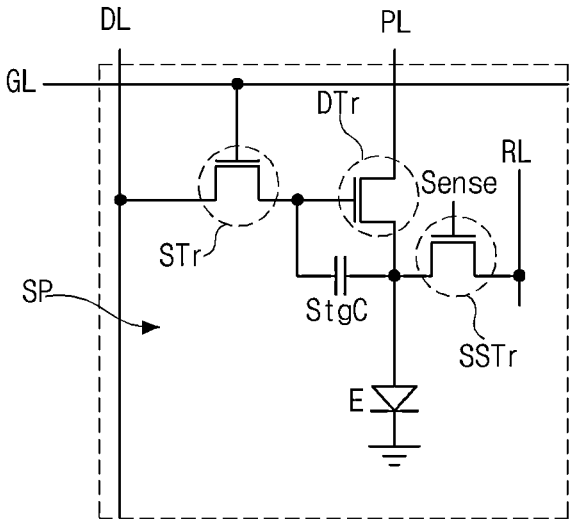
FIG. 7 is a view illustrating a sub-pixel of an organic light emitting diode display device according to the first exemplary embodiment of the present invention.
Figure 8A:
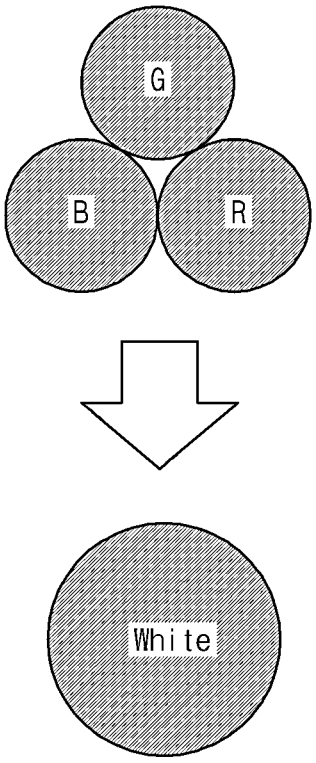
FIGS. 8A to 8C are views illustrating a method of driving an organic light emitting diode display device according to the first exemplary embodiment of the present invention.
Figure 8B:
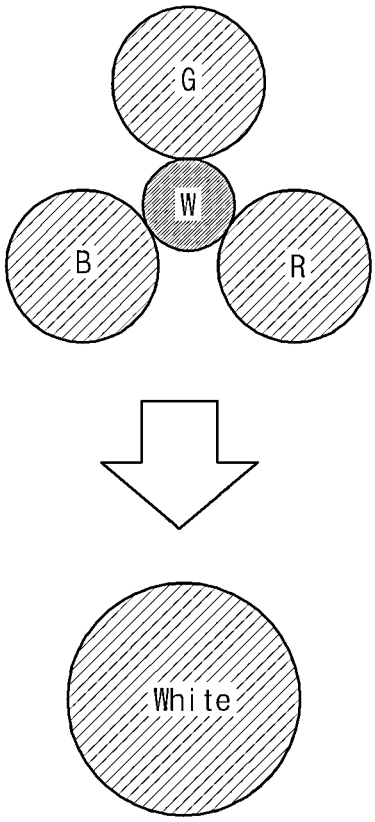
Figure 8C:
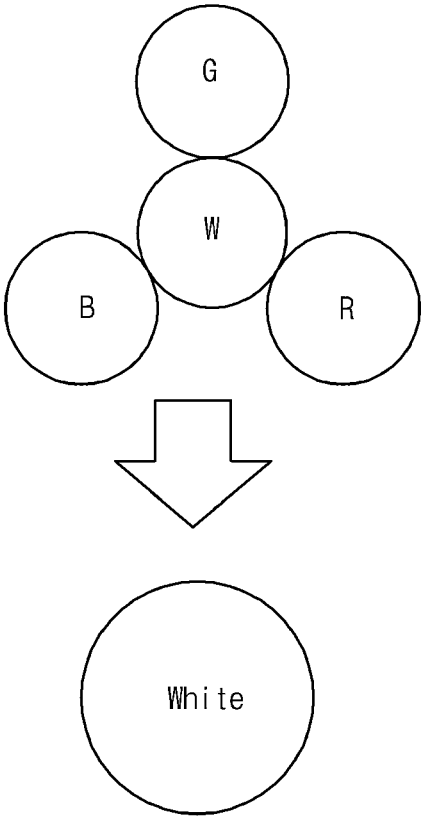

FIG. 6 is a view illustrating an organic light emitting diode display device according to a first exemplary embodiment, FIG. 7 is a view illustrating a sub-pixel of an organic light emitting diode display device according to the first exemplary embodiment, and FIGS. 8A to 8C are views illustrating a method of driving an organic light emitting diode display device according to the first exemplary embodiment.

In FIGS. 6 and 7, an organic light emitting diode (OLED) display device according to the first exemplary embodiment includes a display panel 110 displaying an image, a data driver 120 supplying a data signal, a gate driver 130 supplying a gate signal and a timing controller 140 controlling the data driver 120 and the gate driver 130.

The display panel 110 includes a plurality of gate lines GL along a first direction and a plurality of data lines DL along a second direction. The plurality of gate lines GL and the plurality of data lines DL cross each other to define a plurality of sub-pixels SP. Four sub-pixels SP including a white W sub-pixel constitute a single pixel. For example, the four sub-pixels SP may include white W, red R, green G and blue B sub-pixels SP.

With reference to FIG. 7, each sub-pixel SP includes a switching thin film transistor (TFT) STr, a driving TFT DTr, a sensing TFT SSTr, a storage capacitor StgC and a light emitting diode E. The switching TFT STr is connected to the data line DL and the gate line GL, and the driving TFT DTr is connected to the switching TFT STr. The sensing TFT SSTr is connected to the driving TFT DTr.

A gate electrode of the switching TFT STr is connected to the gate line GL, a source electrode of the switching TFT STr is connected to the data line DL, and a drain electrode of the switching TFT STr is connected to a gate electrode of the driving TFT DTr. The switching TFT STr is turned on/off according to a gate signal through the gate line GL. When the switching TFT STr is turned on, a data signal of the data line DL is applied to the driving TFT DTr through the switching TFT STr.

A drain electrode of the driving TFT DTr is connected to a power line PL and a source electrode of the driving TFT DTr is connected to the light emitting diode E. The driving TFT DTr may adjust a current flowing through the light emitting diode E. For example, the current flowing through the light emitting diode may be proportional to a square of a magnitude of the data signal applied to the driving TFT DTr.

The storage capacitor StgC is connected between the gate electrode and the source electrode of the driving TFT DTr. The storage capacitor StgC stores the data signal applied through the data line DL when the switching TFT STr is turned on. Accordingly, the storage capacitor StgC maintains the data signal during one frame so that the current flowing through the light emitting diode E and the gray level displayed by the light emitting diode E can be kept constant.

The sensing TFT SSTr is connected to the source electrode of the driving TFT DTr and a reference line RL. A gate electrode of the sensing TFT SSTr is connected to a sensing line (not shown) so that the sensing TFT SSTr can be turned on/off according to a sensing signal Sense of the sensing line. The sensing signal Sense may be generated in the gate driver 130 (of FIG. 6). Accordingly, the gate driver 130 (of FIG. 6) may generate a plurality of signals including the gate signal and the sensing signal.

The sensing TFT SSTr detects a change of a threshold voltage Vth of the driving TFT DTr. In addition, the change of the threshold voltage Vth is transmitted to the timing controller 140 (of FIG. 6) and the change of the threshold voltage Vth of the driving TFT DTr is compensated. As a result, the current flowing through the light emitting diode E is kept constant so that the OLED display device can display an image of high quality with a uniform luminance.

The current level flowing through the light emitting diode E is kept constant by three TFTs and one capacitor (3T1C) in each sub-pixel SP. In the OLED display device, as a driving time increases, deterioration is accelerated and emission ability decreases. Since the deterioration speeds of the light emitting diode E are different in the sub-pixels, display quality of the OLED display device may be maintained by adjusting the current flowing through the light emitting diode of each sub-pixel.

With reference to FIG. 6, the data driver 120 generates the data signal using a modulated image data and a plurality of data control signals of the timing controller 140. The data driver 120 supplies the data signal to the display panel 110 through the data line DL.

Although not shown, the data driver 120 may include at least one of a shift register generating a sequential clock signal synchronized with the data control signals, a latch sequentially holding and simultaneously outputting the image data synchronized with the clock signal, a converter converting the image data of a digital type to the data signal of an analog type and an output buffer stabilizing and outputting the data signal.

The gate driver 130 generates the gate signal using a plurality of gate control signals of the timing controller 140 and supplies the gate signal to the display panel 110 through the gate line GL. The gate driver 130 may generate the sensing signal using the plurality of gate control signals and may supply the sensing signal to the display panel 110 through the sensing line. The gate driver 130 may be formed on an edge portion of the display panel 110 of a gate in panel (GIP) type.

The timing controller 140 receives a plurality of signals such as an image data, a vertical synchronization signal Vsync, a horizontal synchronization signal Hsync and a data enable signal DE from an external system such as a graphic card through an interface. In addition, the timing controller 140 generates the modulated image data, the plurality of data control signals and the plurality of gate control signals. The timing controller 140 supplies the modulated image data and the plurality of data control signals to the data driver 120 and supplies the plurality of gate control signals to the gate driver 130. The image data may include red, green and blue components and the modulated image data may include red, green, blue and white components.

The timing controller 140 further includes a gray level judging part 145 that judges a gray level of the image data. For example, the gray level judging part 145 may analyze the gray level of the image data and may classify the image data into three groups: a low gray level group, a middle gray level group and a high gray level group. The gray level judging part 145 may analyze the gray levels for red, green and blue sub-pixels of the image data of a single frame. The gray level is a range of shades that gradually changes from a bright part to a dark part in the image data. For example, image data of 8 bits may have total 256 gray levels, i.e., from the $0^{th}$ gray level to the $255^{th}$ gray level. In addition, the low gray level group may be within a range of the $0^{th}$ gray level to the $96^{th}$ gray level, the middle gray level group may be within a range of the $96^{th}$ gray level to the $160^{th}$ gray level, and the high gray level group may be within a range of the $160^{th}$ gray level to the $255^{th}$ gray level.

The timing controller 140 determines gray levels of red, green, blue and white components for red, green, blue and white sub-pixels according to a result of the judgment of the gray level judging part 145. Moreover, the timing controller 140 generates a modulated image data according to the gray levels of the red, green, blue and white components and supplies the modulated image data to the data driver 120.

For example, when the image data is classified into the low gray level group by the gray level judging part 145, the timing controller 140 may determine the gray level of the white component for the white sub-pixel as $0^{th}$ gray level and may generate the modulated image data using the white component of $0^{th}$ gray level.

Figure 9:
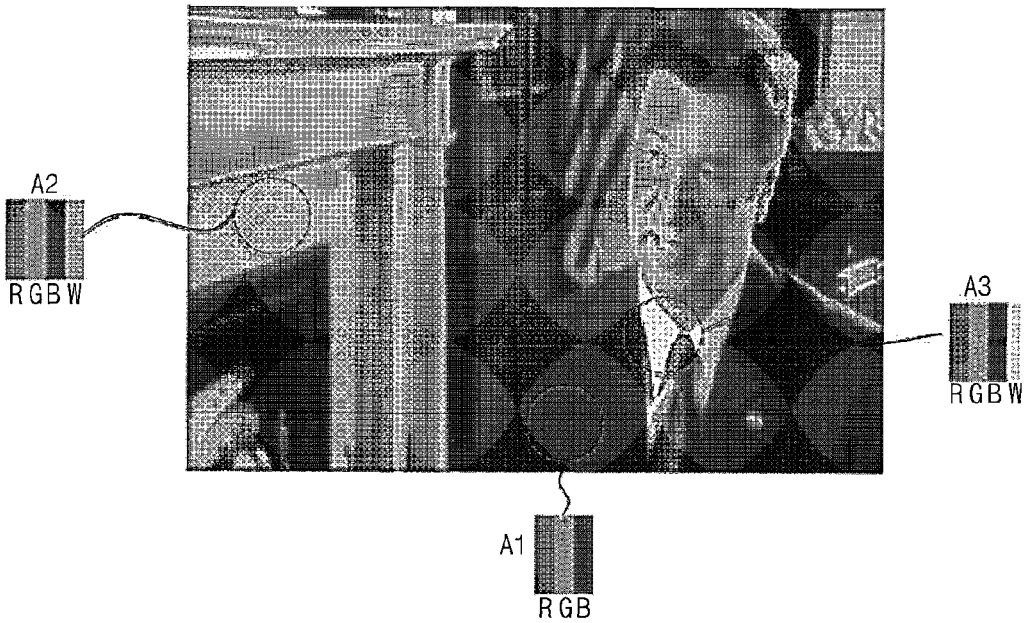
FIG. 9 is a picture illustrating an image displayed by an organic light emitting diode display device according to the first exemplary embodiment of the present invention.

FIGS. 8A to 8C are views illustrating a method of driving an organic light emitting diode display device according to a first exemplary embodiment. Further, FIG. 9 is a picture illustrating an image displayed by an organic light emitting diode display device according to the first exemplary embodiment.

As illustrated in FIG. 8A, the white image of the low gray level group is displayed by the red, green and blue sub-pixels except the white sub-pixel. For example, a data voltage of the data signal applied to the white sub-pixel may be determined to be about 0 with respect to a reference value of 1, and the data voltage of the data signal applied to each of the red, green and blue sub-pixels may be determined to be about 1 with respect to the reference value of 1. As a result, the data voltages applied to the red, green, blue and white sub-pixels may have a ratio of about 1:1:1:0. The reference value may correspond to a data voltage applied to the red, green, blue and white sub-pixels of the OLED display device according to the related art.

Moreover, when the image data is classified into the middle gray level group by the gray level judging part 145, the timing controller 140 may determine the gray level of the white component for the white sub-pixel as a value smaller than the gray level of the red, green and blue components for the red, green and blue sub-pixels and may generate the modulated image data using the white component having the gray level smaller than the red, green and blue components. Accordingly, as illustrated in FIG. 8B, the white image of the middle gray level group is displayed by the red, green, blue and white sub-pixels where the luminance of the white sub-pixel is smaller than the luminance of each of the red, green and blue sub-pixels.

For example, a data voltage of the data signal applied to the white sub-pixel may be determined to be about 0.5 with respect to a reference value of 1, and the data voltage of the data signal applied to each of the red, green and blue sub-pixels may be determined to be about 1.5 with respect to the reference value of 1. As a result, the data voltages applied to the red, green, blue and white sub-pixels may have a ratio of about 1.5:1.5:1.5:0.5.

In the OLED display device according to the related art, the data voltages applied to the red, green, blue and white sub-pixels have a ratio of about 1:1:1:1 for the image data of the low and middle gray level groups. In the OLED display device according to the exemplary embodiment, the data voltages applied to the red, green, blue and white sub-pixels have a ratio of about 1:1:1:0 for the image data of the low gray level group and have a ratio of about 1.5:1.5:1.5:0.5 for the image data of the middle gray level group.

When the image data is classified into the high gray level group by the gray level judging part 145, the timing controller 140 may determine the gray level of the white component for the white sub-pixel as a value equal to the gray level of the red, green and blue components for the red, green and blue sub-pixels and may generate the modulated image data using the white component having the gray level equal to the red, green and blue components. Accordingly, as shown in FIG. 8C, the white image of the high gray level group is displayed by the red, green, blue and white sub-pixels where the data voltage applied to the white sub-pixel is equal to the data voltage applied to each of the red, green and blue sub-pixels.

The gray level judging part 145 may be formed as an individual element outside the timing controller 140 in another exemplary embodiment.

In the OLED display device according to the first exemplary embodiment, the gray level of the white component of the image data is determined according to the gray level group of the image data and the data voltage applied to the white sub-pixel has different levels according to the gray level group of the image data. As a result, the current flowing through the light emitting diode E is adjusted and the OLED display device displays an image with improved luminance uniformity.

FIG. 9 is a picture showing an image displayed by an organic light emitting diode display device according to the first exemplary embodiment.

As shown in FIG. 9, a first white image A1 of the low gray level group may be displayed by the red, green and blue sub-pixels except the white sub-pixel such that the luminance of the white sub-pixel is 0, and thus, for example, the data voltages applied to the red, green, blue and white sub-pixels may have a ratio of about 1:1:1:0. Also, a second white image A2 of the middle gray level group may be displayed by the red, green, blue and white sub-pixels such that the luminance of the white sub-pixel is smaller than the luminance of each of the red, green and blue sub-pixels. Thus, for example, the data voltages applied to the red, green, blue and white sub-pixels may have a ratio of about 1.5:1.5:1.5:0.5. Moreover, a third white image A3 of the high gray level group may be displayed by the red, green, blue and white sub-pixels such that the luminance of the white sub-pixel is equal to the luminance of each of the red, green and blue sub-pixels. Thus, for example, the data voltages applied to the red, green, blue and white sub-pixels may have a ratio of about 1:1:1:1.

In the OLED display device, since the data voltage applied to the white sub-pixel is adjusted according to the gray level group of the image data, the optical property of white color is improved and thus the OLED display device displays an image with improved luminance uniformity.

Figure 10A:
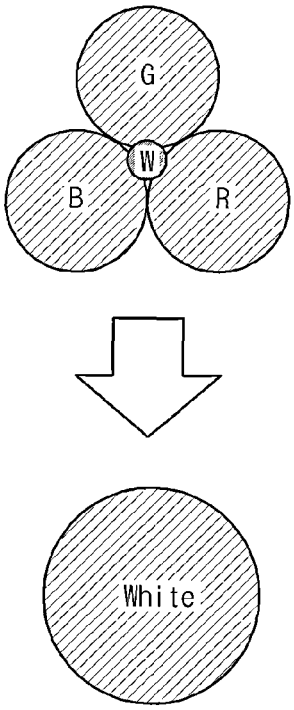
FIGS. 10A to 10C are views illustrating a method of driving an organic light emitting diode display device according to a second exemplary embodiment of the present invention.
Figure 10B:
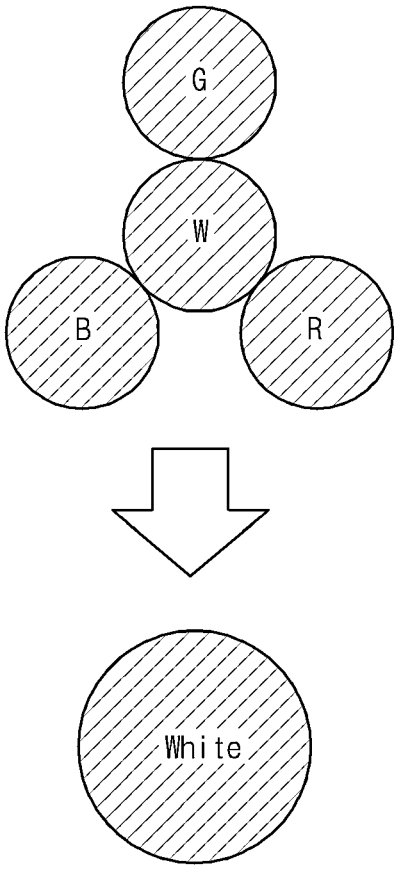
Figure 10C:
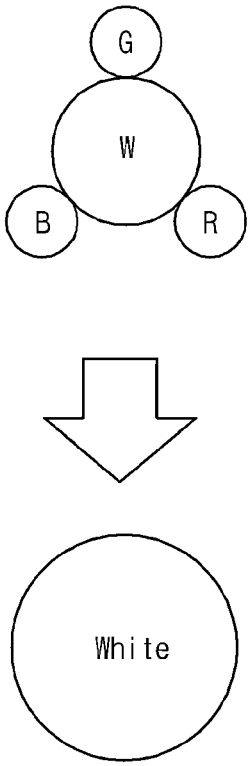
Figure 11:
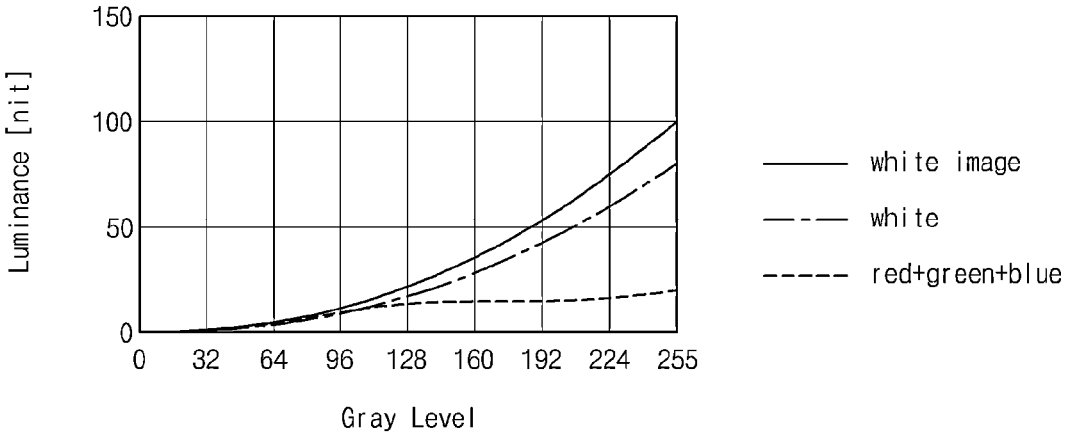
FIG. 11 is a graph illustrating a luminance according to a gray level of an organic light emitting diode display device according to the second exemplary embodiment of the present invention.
Figure 12:
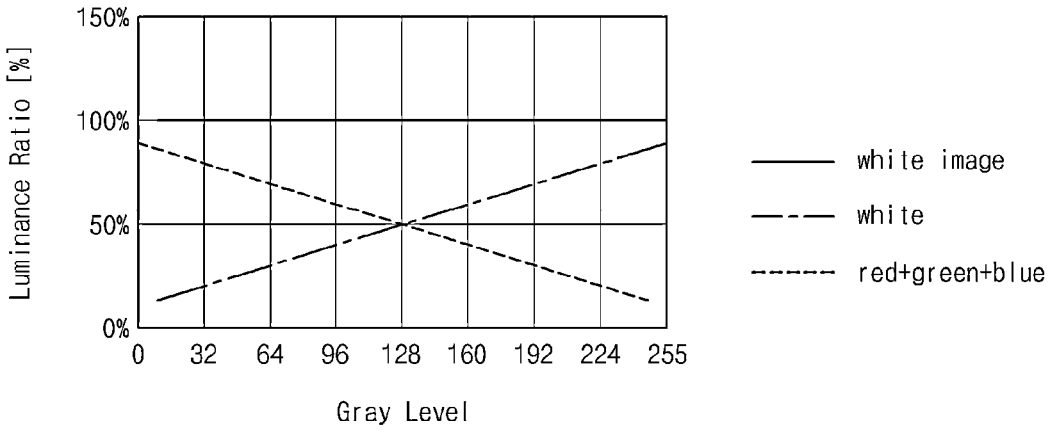
FIG. 12 is a graph illustrating a luminance ratio according to a gray level of an organic light emitting diode display device according to the second exemplary embodiment of the present invention.
Figure 13:
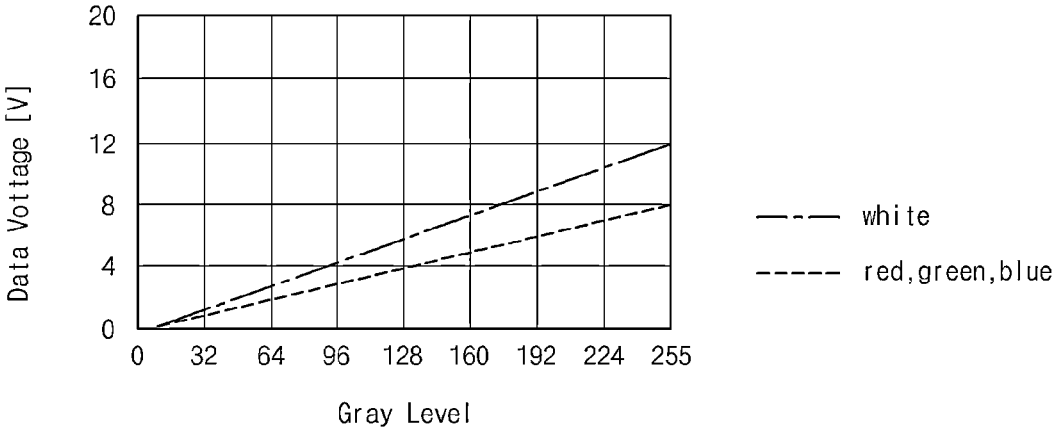
FIG. 13 is a graph illustrating a data voltage according to a gray level of an organic light emitting diode display device according to the second exemplary embodiment of the present invention.

FIGS. 10A to 10C are views illustrating a method of driving an organic light emitting diode display device according to a second exemplary embodiment. Further, FIG. 11 is a graph illustrating a luminance according to a gray level of an organic light emitting diode display device according to the second exemplary embodiment. FIG. 12 is a graph showing a luminance ratio according to a gray level of an organic light emitting diode display device according to the second exemplary embodiment. FIG. 13 is a graph showing a data voltage according to a gray level of an organic light emitting diode display device according to the second exemplary embodiment.

An OLED display device of the second exemplary embodiment includes the same structure as the OLED display device of the first exemplary embodiment of FIG. 6. Accordingly, a gray level of an image data is judged by a gray level judging part, and a timing controller generates a modulated image data according to the gray level of the image data. The timing controller supplies the modulated image data to a data driver.

In a method of driving an OLED display device according to the second embodiment, the white image is displayed by the red, green, blue and white sub-pixels and the luminance ratio of the red, green, blue and white sub-pixels are adjusted.

In FIGS. 10A to 10C, the data voltages applied to the red, green, blue and white sub-pixels may be determined according to a data voltage ratio and the luminance of the red, green, blue and white sub-pixels may be determined according to a luminance ratio.

The data voltage ratio applied to each of the red, green and blue sub-pixels may be defined as follows:

$$DVR_r = DV_w/DV_r,\ DVR_g = DV_w/DV_g,\ DVR_b = DV_w/DV_b,$$

where DVRr, DVRg and DVRb are data voltage ratios of the red, green and blue sub-pixels, respectively, and DVw, DVr, DVg and DVb are data voltages of the red, green, blue and white sub-pixels, respectively.

The data voltage ratios of the low, middle and high gray level groups may be determined as follows:

$$DVR_r(l) < DVR_r(m) < DVR_r(h),\ DVR_g(l) < DVR_g(m) < DVR_g(h),\ DVR_b(l) < DVR_b(m) < DVR_b(h),$$

where DVRr(l), DVRr(m) and DVRr(h) are the data voltage ratios of the red sub-pixels of the low, middle and high gray level groups, respectively, DVRg(l), DVRg(m) and DVRg(h) are data voltage ratios of the green sub-pixels of the low, middle and high gray level groups, respectively, and DVRb(l), DVRb(m) and DVRb(h) are data voltage ratios of the blue sub-pixels of the low, middle and high gray level groups, respectively.

In addition, the luminance ratio of the white sub-pixel may be defined as follows:

$$LR_w = L_w/(L_r + L_g + L_b + L_w),$$

where LRw is a luminance ratio of the white sub-pixel, and Lr, Lg, Lb and Lw are luminances of the red, green, blue and white sub-pixels, respectively.

The luminance ratios of the low, middle and high gray level groups may be determined as follows:

$$LR_w(l) < LR_w(m) < LR_w(h),$$

where LRw(l), LRw(m) and LRw(h) are the luminance ratios of the white sub-pixel of the low, middle and high gray level groups, respectively.

In FIG. 10A, when the image data is classified into the low gray level group by the gray level judging part 145, the timing controller 140 may determine the data voltage of a data signal applied to the white sub-pixel as a value smaller than a reference value and may determine the data voltage applied to each of the red, green and blue sub-pixels as a value greater than the reference value to adjust the luminance ratio. The reference value may correspond to a data voltage applied to the red, green, blue and white sub-pixels of the OLED display device according to the related art.

For example, a data voltage of the data signal applied to the white sub-pixel may be determined to be about 0.5 with respect to a reference value of 1, and the data voltage of the data signal applied to each of the red, green and blue sub-pixels may be determined to be about 1.5 with respect to the reference value of 1. As a result, the data voltages applied to the red, green, blue and white sub-pixels may have a ratio of about 1.5:1.5:1.5:0.5.

For the low gray level group in FIGS. 11 to 13, since the data voltage greater than the reference value is applied to each of the red, green and blue sub-pixels, the luminance of the red, green and blue sub-pixels is greater than the luminance of the white sub-pixel. For example, as shown in FIG. 12, the luminance ratio of the red, green and blue sub-pixels is greater than the luminance ratio of the white sub-pixel for a $96^{th}$ gray level of the low gray level group. Since the data voltage applied to the red, green and blue sub-pixels increases for the low gray level group, influence of noise is minimized and luminance uniformity is improved.

In FIG. 10B, when the image data is classified into the middle gray level group by the gray level judging part 145, the timing controller 140 may determine the data voltage of a data signal applied to the white sub-pixel such that the luminance ratio of the red, green and blue sub-pixels and the luminance ratio of the white sub-pixel are inversely proportional to each other.

For example, as the gray level increases, a data voltage of the data signal applied to the white sub-pixel may be determined to gradually increase with a first slope and a data voltage of the data signal applied to each of the red, green and blue sub-pixels may be determined to gradually increase with a second slope smaller than the first slope.

For the middle gray level group in FIGS. 11 to 13, since the data voltage gradually increasing is applied to the red, green, blue and white sub-pixels, the uniform luminance is obtained. For example, as shown in FIG. 12, the luminance ratio of the red, green and blue sub-pixels is equal to the luminance ratio of the white sub-pixel for a $128^{th}$ gray level of the middle gray level group. Since the data voltage applied to the red, green, blue and white sub-pixels gradually increases for the middle gray level group, luminance uniformity is improved.

In FIG. 10C, when the image data is classified into the high gray level group by the gray level judging part 145, the timing controller 140 may determine the data voltage applied to the white sub-pixel as a value equal to the data voltage applied to each of the red, green and blue sub-pixels. Accordingly, the white image of the high gray level group is displayed by the red, green, blue and white sub-pixels where the luminance of the white sub-pixel is greater than the luminance of each of the red, green and blue sub-pixels.

For the high gray level group in FIGS. 11 to 13, the luminance ratio of the white sub-pixel is about 80% and the luminance ratio of the red, green and blue sub-pixels is about 20% for a $255^{th}$ gray level of the high gray level group.

Figure 1:
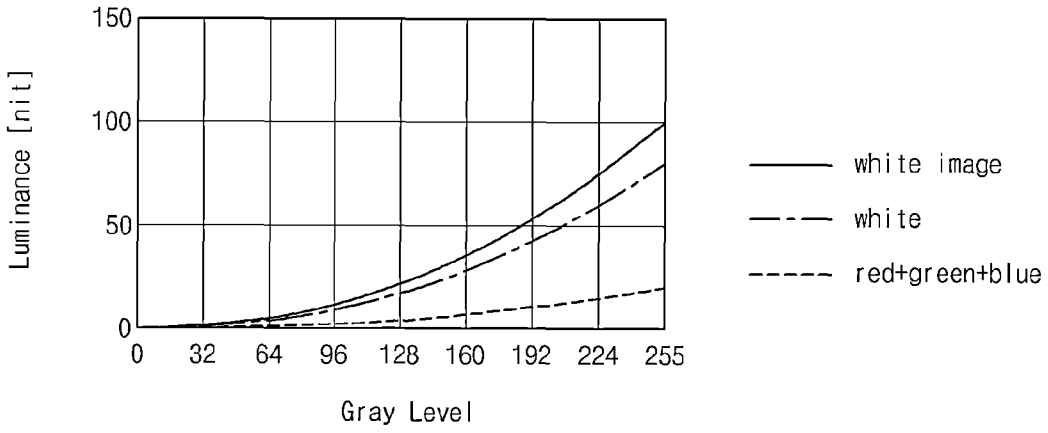
FIG. 1 (related art)
FIG. 1 is a graph illustrating a luminance according to a gray level of an organic light emitting diode display device having red, green, blue and white sub-pixels according to the related art.
Figure 2:
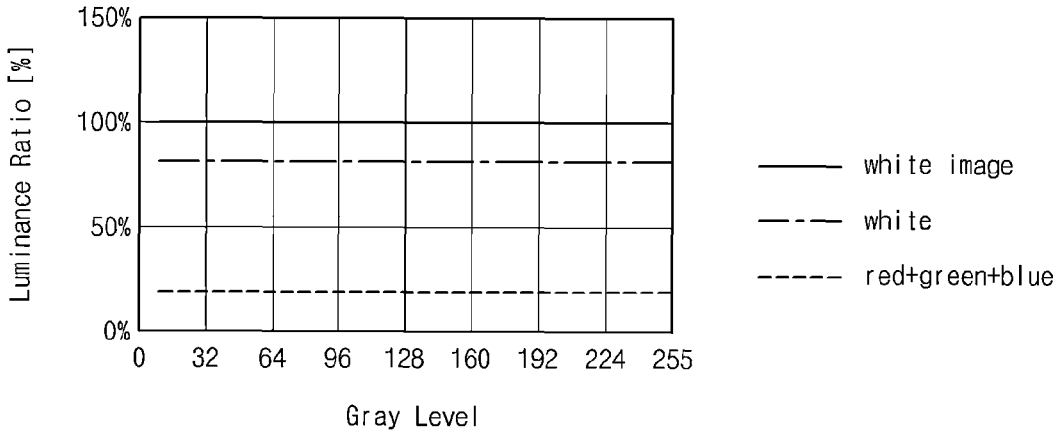
FIG. 2 (related art)
FIG. 2 is a graph illustrating a luminance ratio according to a gray level of an organic light emitting diode display device having red, green, blue and white sub-pixels according to the related art.
Figure 3:
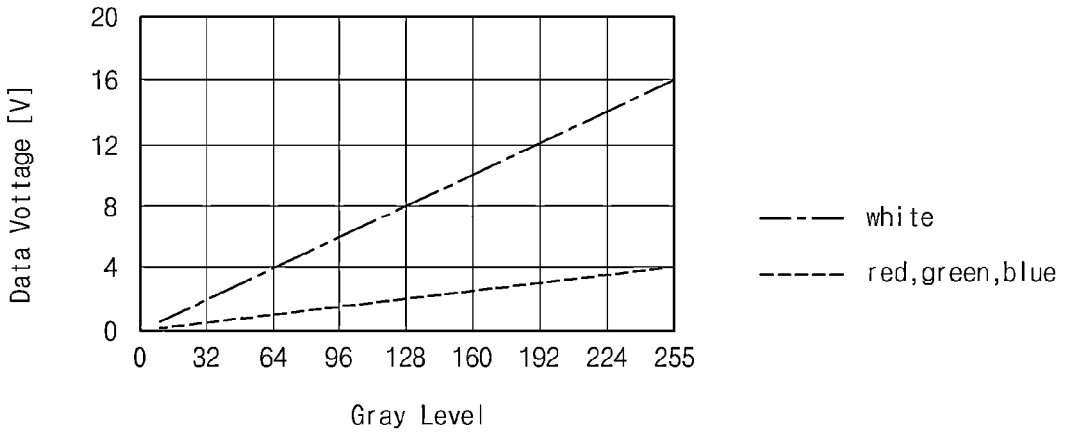
FIG. 3 (related art)
FIG. 3 is a graph illustrating a data voltage according to a gray level of an organic light emitting diode display device having red, green, blue and white sub-pixels according to the related art.
Figure 4:
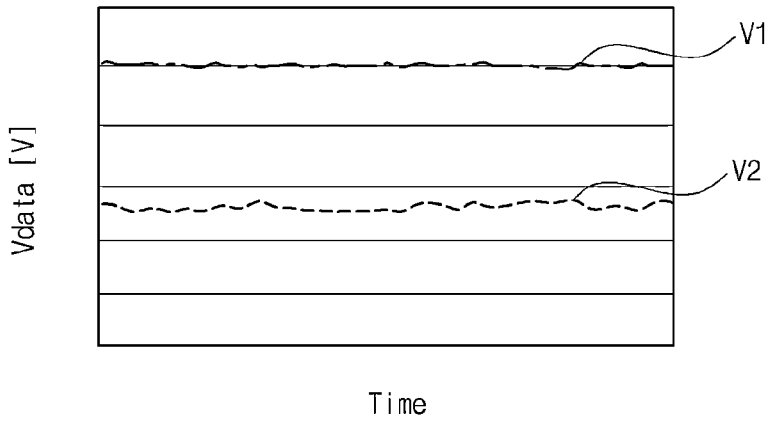
FIG. 4 (related art)
FIG. 4 is a graph illustrating a fluctuation of a data voltage due to a noise of an organic light emitting diode display device according to the related art.
Figure 5:
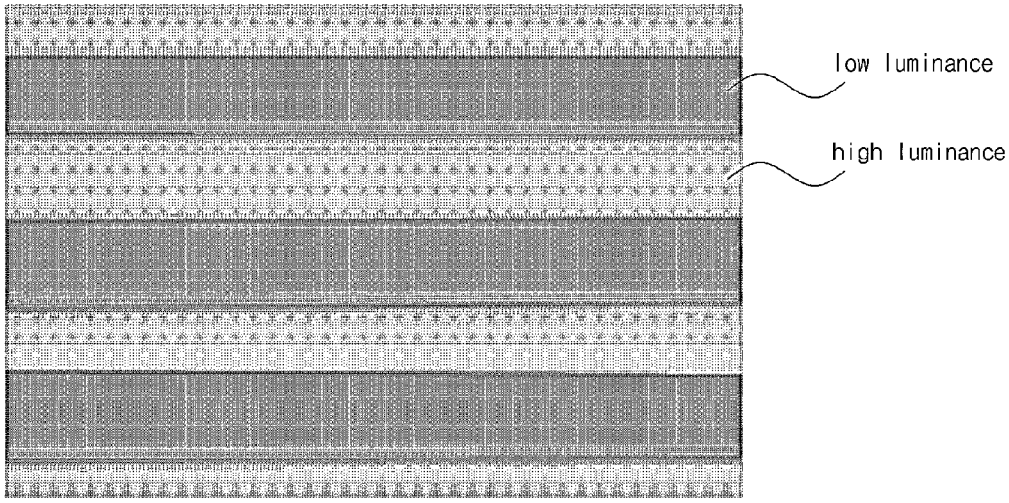
FIG. 5 (related art)
FIG. 5 is a picture illustrating a non-uniformity in luminance when a relatively low gray level is expressed by an organic light emitting diode display device according to the related art.

In the OLED display device according to the second exemplary embodiment, the gray levels of the red, green, blue and white components of the image data is determined according to the gray level group of the image data and the data voltages applied to the red, green, blue and white sub-pixels have different levels according to the gray level group of the image data. For example, the data voltage applied to the white sub-pixel may be reduced as compared with the data voltage applied to the white sub-pixel of the related art and the data voltage applied to the red, green and blue sub-pixels may be increased as compared with the data voltage applied to the red, green and blue sub-pixels according to the related art. While the data voltage of the white sub-pixel is about 6V and the data voltage of the red, green and blue sub-pixels is about 2V for the $96^{th}$ gray level of FIG. 3, the data voltage of the white sub-pixel is about 5V and the data voltage of the red, green and blue sub-pixels is about 3V for the $96^{th}$ gray level of FIG. 13. As a result, the influence of noise is minimized and luminance uniformity is improved. Further, the difference in data voltages applied to the white sub-pixel and the red, green and blue sub-pixels is reduced.

Consequently, in a method of driving an OLED display device according to the exemplary embodiments, luminance uniformity is improved by adjusting the data voltage applied to the white sub-pixel according to the gray level of the image data. Specifically, the non-uniform luminance in the image of the low gray level group is prevented. In addition, luminance uniformity is improved by adjusting the data voltages applied to the red, green, blue and white sub-pixels according to the gray level of the image data. Specifically, influence of noise is minimized by increasing the data voltage applied to the red, green and blue sub-pixels of the low gray level group. Since the current flowing through the light emitting diode is adjusted due to the data voltage, uniform luminance distribution is obtained.

It will be apparent to those skilled in the art that various modifications and variations can be made in a method of driving an OLED display device of the present disclosure without departing from the sprit or scope of the invention. Thus, it is intended that the present invention covers the modifications and variations of this invention provided they come within the scope of the appended claims and their equivalents.

What is claimed is:

1. A method of driving an organic light emitting diode display device having first to third sub-pixels and a white sub-pixel, comprising: judging a gray level of an image data for the first to third sub-pixels as a group, the gray level representing a brightness of a white portion of the image data;

classifying the gray level of the image data into one of a low gray level group, a middle gray level group and a high gray level group according to the brightness of the gray level of the image data, wherein each of the low gray level group, middle gray level group, and high gray level group includes a brightness range, the brightness range of the middle gray level group is above the brightness range of the low gray level group, and the brightness range of the high gray level group is above the brightness range of the middle gray level group and includes a highest gray level brightness;

displaying an image using the first to third sub-pixels but not the white sub-pixel when the gray level of the image data is classified into the low gray level group;

displaying the image using the first to third sub-pixels and the white sub-pixel when the gray level of the image data is classified into one of the middle and high gray level groups;

generating a first data voltage applied to the white sub-pixel to be smaller than second data voltages applied to the first to third sub-pixels for any gray level when the gray level of the image data is classified into the middle gray level group; and generating the first data voltage applied to the white sub-pixel to be equal to the second data voltages applied to the first to third sub-pixels for any gray level when the gray level of the image data is classified into the high gray level group.

2. The method according to claim 1, wherein the data voltages applied to the first to third sub-pixels and applied to the white sub-pixel have a ratio of 1.5:1.5:1.5:0.5 when the gray level of the image data is classified into the middle gray level group.

3. The method according to claim 1, wherein the data voltages applied to the first to third sub-pixels and applied to the white sub-pixel have a ratio of 1:1:1:1 when the gray level of the image data is classified into the high gray level group.

4. The method according to claim 1, wherein a luminance of the white sub-pixel is smaller than a luminance of each of the first to third sub-pixels when the gray level of the image data is classified into the middle gray level group.

5. The method according to claim 1, wherein the image data includes 256 gray levels from $0^{th}$ gray level to $255^{th}$ gray level such that the low gray level group is within a range of $0^{th}$ gray level to $96^{th}$ gray level; the middle gray level group is within a range of $96^{th}$ gray level to $160^{th}$ gray level; and the high gray level group is within a range of $160^{th}$ gray level to $255^{th}$ gray level.

6. The method according to claim 1, wherein the gray level of the image data includes gray levels of red, green and blue components of the image data, wherein the gray levels of the red, green, and blue components each represents a brightness of the respective component, and wherein the image data is thereby classified according to the gray levels of the red, green and blue components.

7. A method of driving an organic light emitting diode display device having first to third sub-pixels and a white sub-pixel, comprising:

judging a gray level of an image data for the first to third sub-pixels as a group, the gray level representing a brightness of a white portion of the image data;

classifying the gray level of the image data into one of a low gray level group, a middle gray level group and a high gray level group according to the brightness of the gray level of the image data, wherein each of the low gray level group, middle gray level group, and high gray level group includes a brightness range, the brightness range of the middle gray level group is above the brightness range of the low gray level group, and the brightness range of the high gray level group is above the brightness range of the middle gray level group and includes a highest gray level brightness; and displaying an image by adjusting a luminance ratio of the first to third sub-pixels and the white sub-pixel according to a result of judging and classifying the gray level of the image data, wherein a luminance of the white sub-pixel is smaller than a luminance of each of the first to third sub-pixels when the gray level of the image data is classified into the low gray level group;

wherein a luminance ratio of the white sub-pixel is inversely proportional to a luminance ratio of the first to third sub-pixels when the gray level of the image data is classified into the middle gray level group; and wherein displaying the image by adjusting the luminance ratio of the first to third sub-pixels and the white sub-pixel includes generating a first data voltage applied to the white sub-pixel to be equal to second data voltages applied to the first to third sub-pixels for any gray level when the gray level of the image data is classified into the high gray level group.

8. The method according to claim 7, further comprising generating the first data voltage applied to the white sub-pixel to be smaller than the second data voltages applied to the first to third sub-pixels for any gray level when the gray level of the image data is classified into the low gray level group.

9. The method according to claim 8, wherein the data voltages applied to the first to third sub-pixels and the data voltage applied to the white sub-pixel have a ratio of 1.5:1.5:1.5:0.5 when the gray level of the image data is classified into the low gray level group.

10. The method according to claim 7, further comprising generating the first data voltage applied to the white sub-pixel to gradually increase with a first slope and the second data voltages applied to the first to third sub-pixels for any gray level to gradually increase with a second slope smaller than the first slope when the gray level of the image data is classified into the middle gray level group.

11. The method according to claim 7, wherein the image data includes 256 gray levels from $0^{th}$ gray level to $255^{th}$ gray level such that the low gray level group is within a range of $0^{th}$ gray level to $96^{th}$ gray level; the middle gray level group is within a range of $96^{th}$ gray level to $160^{th}$ gray level; and the high gray level group is within a range of $160^{th}$ gray level to $255^{th}$ gray level.

* * * * *